US006533610B1

(12) United States Patent
Dai et al.

(10) Patent No.: US 6,533,610 B1
(45) Date of Patent: Mar. 18, 2003

(54) LOW-PROFILE RF CONNECTOR ASSEMBLY

(75) Inventors: Hsin Kuo Dai, Tu-Chen (TW); David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/036,052

(22) Filed: Dec. 24, 2001

(51) Int. Cl.[7] ..... H01R 9/05
(52) U.S. Cl. ..... 439/581
(58) Field of Search ..... 439/581, 63

(56) References Cited

U.S. PATENT DOCUMENTS 5,078,621 A * 1/1992 Nishikawa et al. ..... 439/581
5,180,315 A * 1/1993 Nagashima ..... 439/581
5,322,453 A * 6/1994 Resnick et al. ..... 439/63
5,466,130 A * 11/1995 Ogura ..... 439/63
5,482,477 A * 1/1996 Michael ..... 439/581
5,882,210 A * 3/1999 Embo et al. ..... 439/581
6,074,217 A * 6/2000 Manuyama et al. ..... 439/581
6,431,915 B1 * 8/2002 Ko ..... 439/581

* cited by examiner

*Primary Examiner*—Gary Paumen
(74) *Attorney, Agent, or Firm*—Wei Te Chung

(57) ABSTRACT

An RF connector assembly comprises a receptacle (10), a complementary plug (20), and a printed circuit board (PCB) (30). The receptacle includes a substrate (12), an outer contact (14), a central contact (16), and three solder pads (18, 19) disposed on the substrate. A through hole (36) is defined in a middle of the PCB. The outer and central contacts are accommodated in the through hole. The solder pads are soldered to a bottom face of the PCB. The plug is electrically connected with the receptacle within the through hole. Thus an overall profile of the RF connector assembly above a top face of the PCB is reduced in height.

11 Claims, 4 Drawing Sheets

LOW-PROFILE RF CONNECTOR ASSEMBLY

BACKGROUND OF THE INVENTION

1. Field of the Invention

The present invention relates to RF connector assemblies, and particularly to RF connector assemblies attached to printed circuit boards (PCBs).

2. Related Art

A conventional RF connector assembly is disclosed in U.S. Pat. No. 5,180,315. With reference to FIG. 1, the RF connector assembly comprises a receptacle 1 and a plug 2. Contacts 40 of the receptacle 1 are soldered to a top face of a printed circuit board (PCB) 3. The RF connector assembly is thus mounted on the PCB 3.

This type of RF connector assembly has a profile above the printed circuit board 3 equal to a combined height of the receptacle 1 and the plug 2. Such profile is now becoming too high to meet the demands imposed by the modem trend toward low-profile electronic components.

Accordingly, an improved RF connector assembly having a reduced profile above a PCB is desired.

BRIEF SUMMARY OF THE INVENTION

It is an object of the present invention to provide an RF connector assembly which has a reduced profile.

An RF connector assembly in accordance with the present invention comprises a receptacle, a complementary plug, and a printed circuit board (PCB). The receptacle includes a substrate, an outer contact, a central contact, and three solder pads disposed on the substrate. A through hole is defined in a middle of the PCB. The outer and central contacts are accommodated in the through hole. The solder pads are soldered to a bottom face of the PCB. The plug is electrically connected with the receptacle within the through hole. Thus an overall profile of the RF connector assembly above a top face of the PCB is reduced in height.

The foregoing and additional objects, features and advantages in accordance with the present invention will be more apparent from the ensuing detailed description together with the accompanying drawings.

DESCRIPTION OF THE PREFERRED EMBODIMENT

Figure 1:
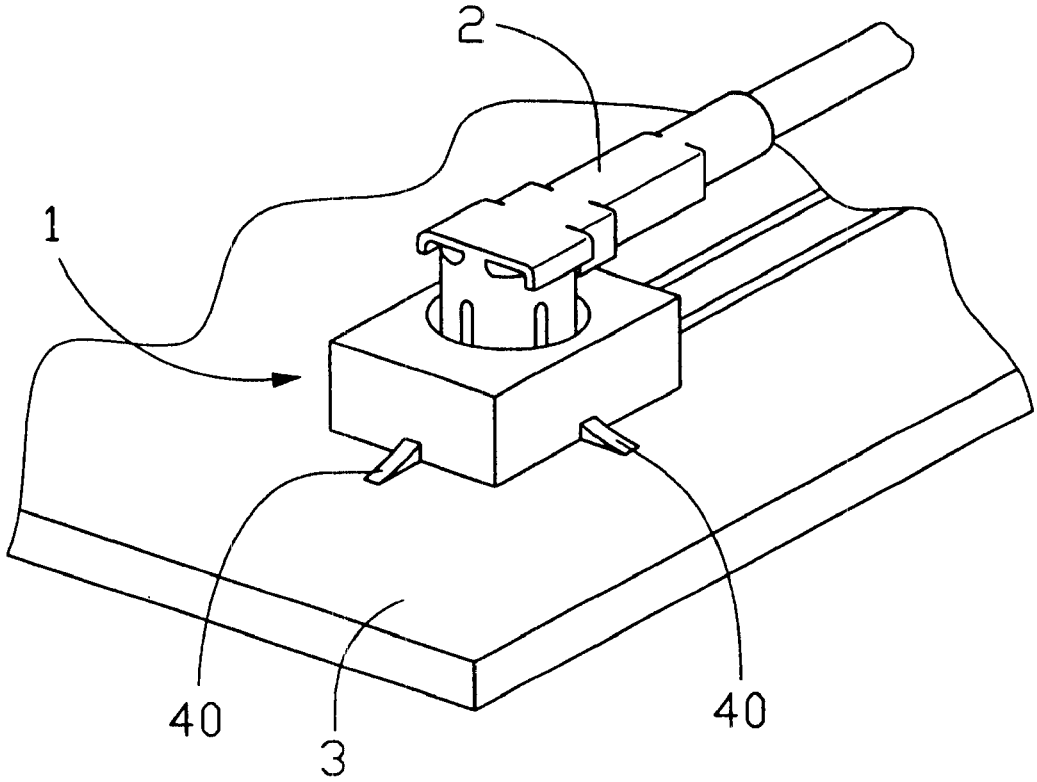
FIG. 1 (PRIOR ART)
FIG. 1 is a perspective view of a conventional RF connector assembly mounted on a printed circuit board.
Figure 2:
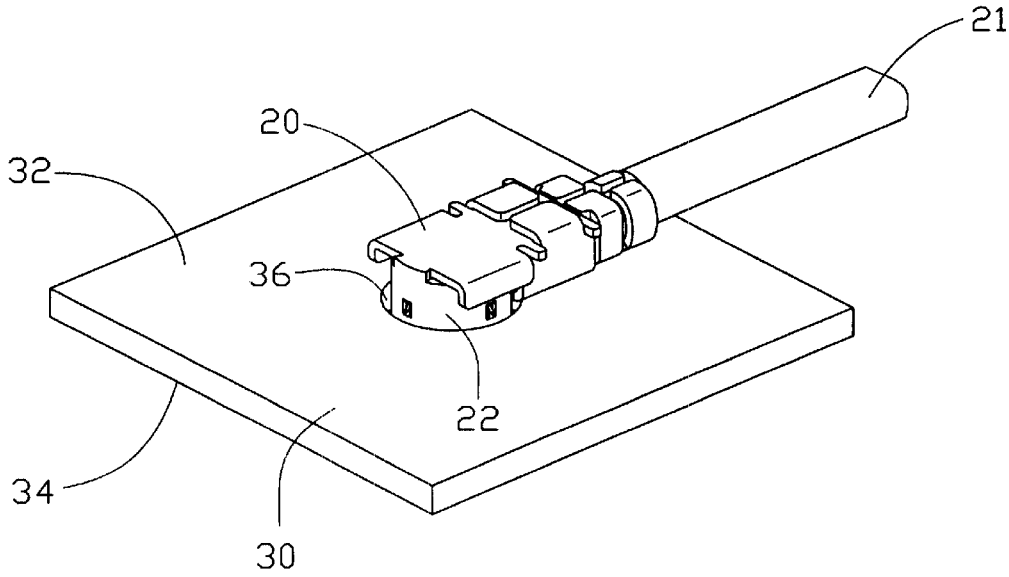
FIG. 2 is a perspective view of an RF connector assembly of the present invention mounted on a printed circuit board.

Referring to FIG. 2, an RF connector assembly in accordance with the present invention is mounted on a printed circuit board (PCB) 30. The RF connector assembly includes a receptacle 10 (see FIG. 3) and a complementary plug 20. The plug 20 comprises a cylindrical mating portion 22, and a bifurcated contact 24 (see FIG. 6). Both the mating portion 22 and the bifurcated contact 24 are made of conductive material, and respectively electrically connect with a braiding and a central conductor (not shown) of a cable 21 of the plug 20. The PCB has a top face 32 and a bottom face 34. A circular through hole 36 is defined in a middle of the PCB 30. The through hole 36 has a diameter corresponding to an outer diameter of the mating portion 22 of the plug 20.

Figure 3:
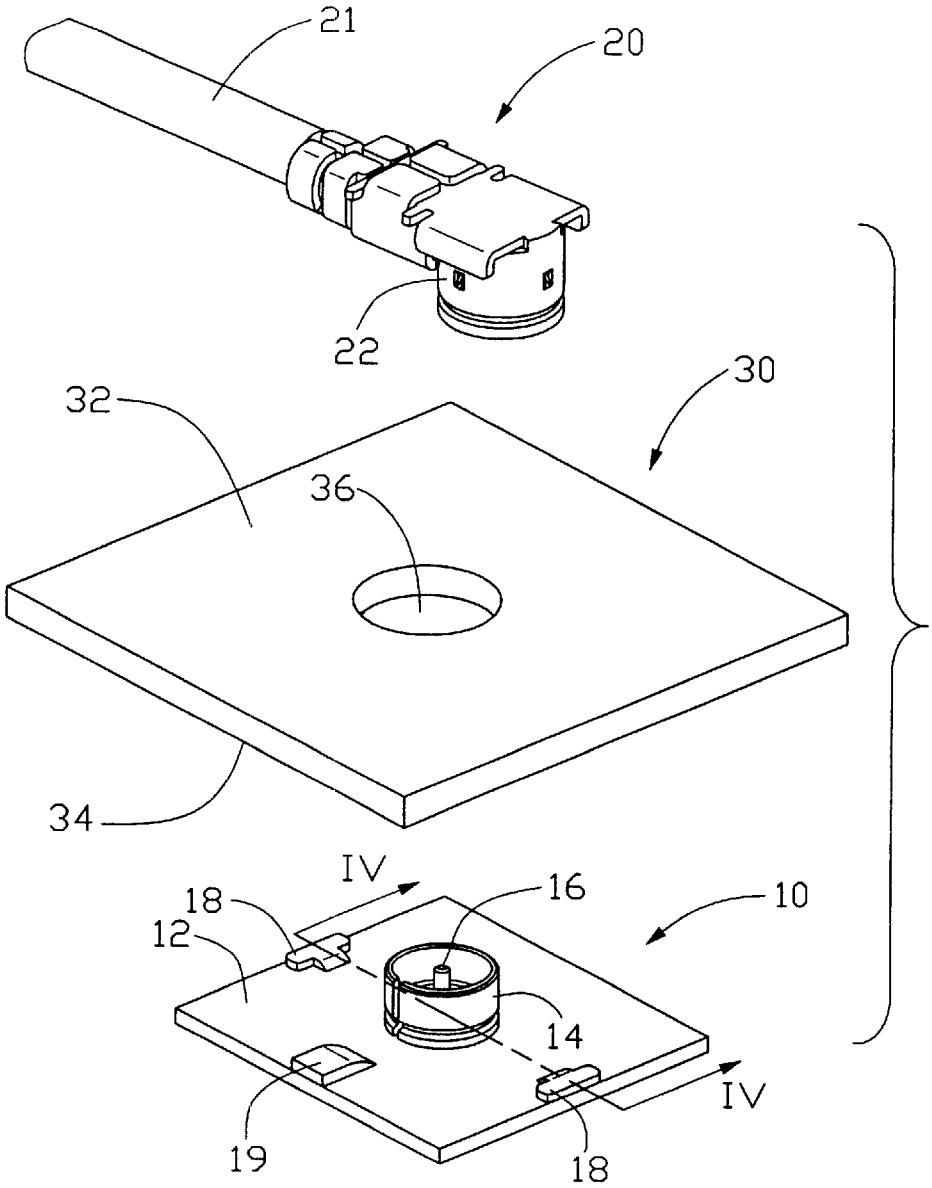
FIG. 3 is an exploded view of FIG. 2, albeit viewed from another aspect.
Figure 4:
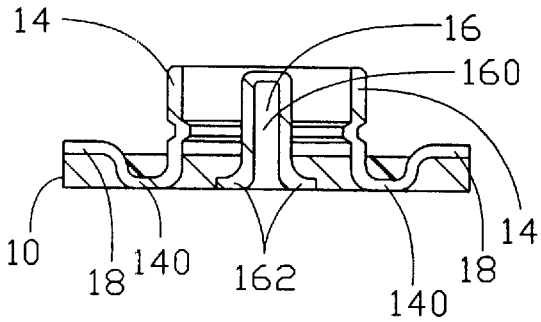
FIG. 4 is a cross-sectional view of a receptacle of the RF connector assembly of FIG. 3, taken along line IV—IV of FIG. 3.

Further referring to FIGS. 3 and 4, the receptacle 10 includes a substrate or housing 12 made of insulative material, an outer contact 14, and a central contact 16 encircled by the outer contact 14. Both the outer contact 14 and the central contact 16 are made of conductive material. A pair of grounding legs 140 extends outwardly from opposite sides of a base of the outer contact 14, respectively. The grounding legs 140 extend within the substrate 12. Each grounding leg 140 has a free end exposed on a top surface of the substrate 12, thus forming a solder pad 18.

Figure 5:
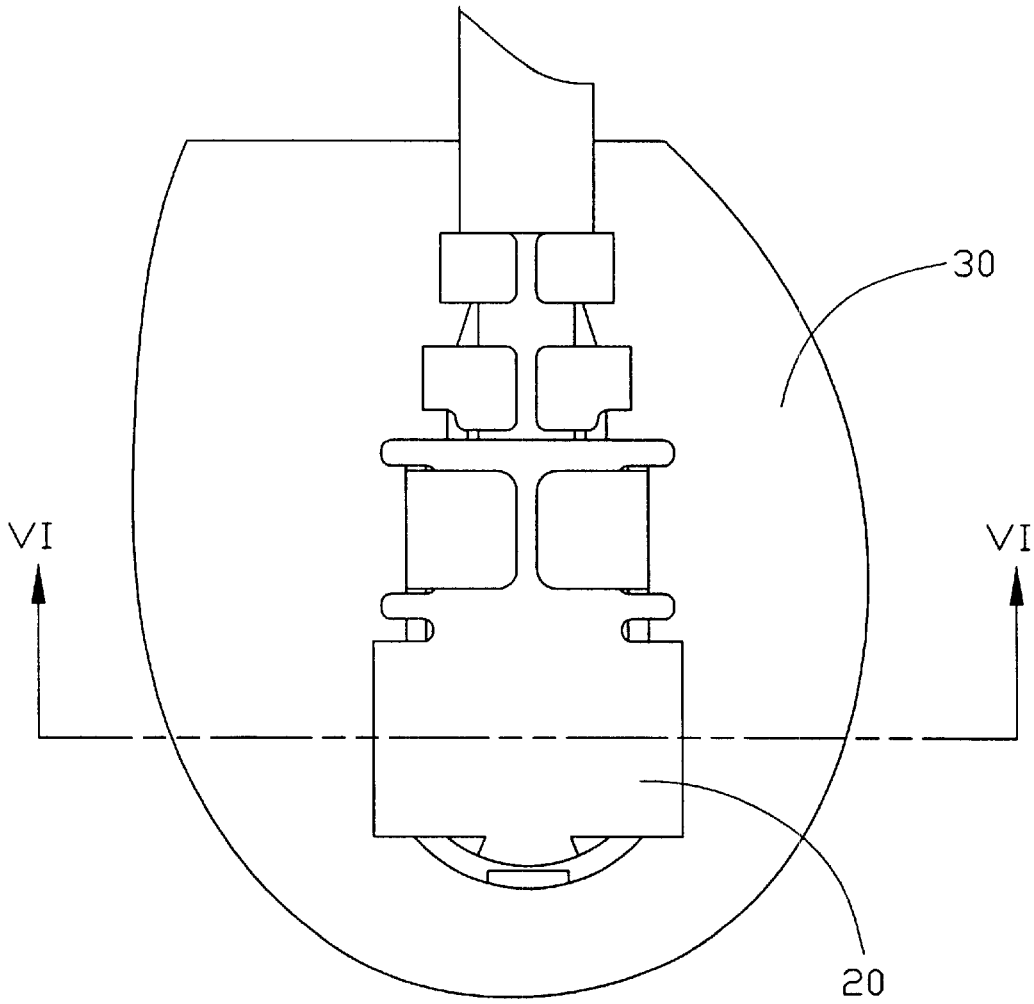
FIG. 5 is a top view of part of FIG. 2.
Figure 6:
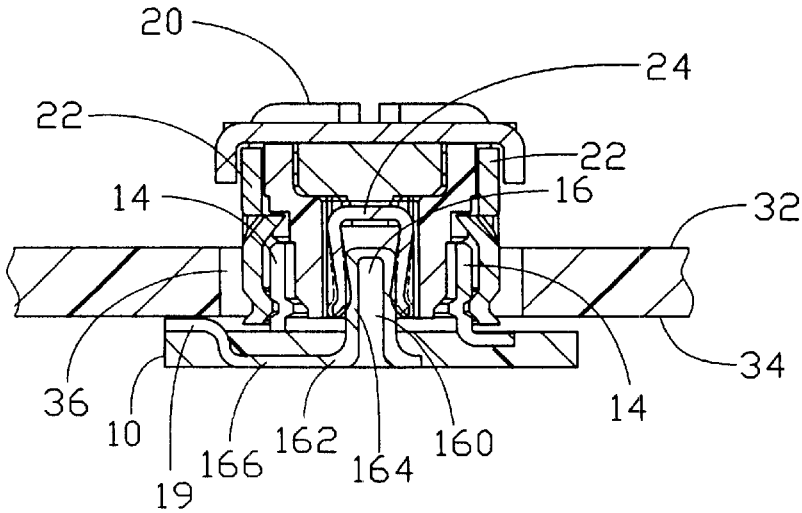
FIG. 6 is a cross-sectional view of the RF connector assembly of FIG. 5, taken along line VI—VI of FIG. 5.

Referring also to FIGS. 5 and 6, the central contact 16 of the receptacle 10 comprises a central pin 160 and a clasp 162 covering the pin 160. The clasp 162 includes a sleeve portion 164, a leg portion 166 and a solder pad 19. The solder pad 19 is formed by a free end of the leg portion 166 being exposed on the top surface of the substrate 12.

In assembly, the outer and central contacts 14, 16 of the receptacle 10 are received in the through hole 36 of the PCB 30. The receptacle 10 is fixed to the bottom face 34 of the PCB 30 by soldering the three solder pads 18, 19 to corresponding solder joints on the bottom face 34. The receptacle 10 and the PCB 30 are thus mechanically and electrically connected together. The plug 20 is then engaged with the receptacle 10 in the through hole 36, from a top of the receptacle 10. An outer periphery of the mating portion 22 of the plug 20 engages with and encircles the outer contact 14 of the receptacle 10. The bifurcated contact 24 of the plug 20 engages with the central contact 16 of the receptacle 10. The bifurcated contact 24 resiliently expands from its original position to a new expanded position (shown by dotted lines in FIG. 6) to thereby receive the central contact 16 therein. Elastic force of the bifurcated contact 24 thus established ensures firm engagement of the plug 20 with the mating portion 22. Because the plug 20 and the mating portion 22 are partly accommodated within the through hole 36 of the PCB 30, a profile of the RF connector assembly above the top face 32 of the PCB 30 is significantly reduced in height.

Although described in the context of the particular embodiment, it will be realized that a number of modifications to these teachings may occur to one skilled in the art. Thus, while the invention has been particularly shown and described with respect to specific embodiments thereof, it will be understood by those skilled in the art that changes in form and shape may be made therein without departing from the scope and spirit of the invention.

We claim:

1. An RF connector assembly comprising:

a printed circuit board having top and bottom faces and a through hole defined between the top and bottom faces;

a receptacle including an insulative substrate, an outer contact fixed to the substrate and having a solder pad on a top face of the substrate, and a central contact fixed to the substrate, the central contact being located in the outer contact and having a solder pad on the top face of the substrate, the solder pads being soldered to the bottom face of the printed circuit board, and the outer contact extending into the through hole of the printed circuit board; and a plug electrically connecting with the outer and central contacts of the receptacle within the through hole of the printed circuit board.

2. The RF connector assembly as claimed in claim 1, wherein the outer contact of the receptacle further includes a grounding leg in the substrate, the leg having a free end located on a top face of the substrate thereby forming the solder pad of the outer contact.

3. The RF connector assembly as claimed in claim 1, wherein the central contact of the receptacle comprises a pin and a clasp covering the pin, the clasp includes a sleeve portion and a leg portion extending from the sleeve portion, and the clasp has a free end forming the solder pad of the central contact.

4. The RF connector assembly as claimed in claim 1, wherein the through hole of the printed circuit board is generally circular, and has a diameter slightly larger than an outer diameter of the mating portion of the plug.

5. An RF connector assembly comprising:

a printed circuit board which defines a through hole therein;

a receptacle including an insulative substrate, an outer contact fixed to the substrate and having a solder pad on a top face of the substrate, and a central contact fixed to the substrate, the central contact being located in the outer contact and having a solder pad on the top face of the substrate, the solder pads being soldered to the printed circuit board, and the outer contact extending into the through hole of the printed circuit board; and a plug electrically connecting with the outer and central contacts of the receptacle within the through hole of the printed circuit board.

6. The RF connector assembly as claimed in claim 5, wherein the through hole of the printed circuit board is round, and has a diameter slightly larger than an outer diameter of the mating portion of the plug.

7. The RF connector assembly as claimed in claim 5, wherein the outer contact of the receptacle further includes a grounding leg in the substrate, the leg having a free end located on a top face of the substrate thereby forming the solder pad of the outer contact.

8. The RF connector assembly as claimed in claim 5, wherein the central contact of the receptacle comprises a pin and a clasp covering the pin, the clasp includes a sleeve portion and a leg portion extending from the sleeve portion, and the clasp has a free end forming the solder pad of the central contact.

9. An electrical connector assembly, comprising:

a printed circuit board having top and bottom faces and a through hole defined between the top and bottom faces;

a first electrical connector comprising a first electrical contact and a second electrical contact encircling the first electrical contact, a first solder pad electrically connecting with the first contact and a second solder pad electrically connecting with the second contact, the first and the second solder pads being soldered to the bottom face of the printed circuit board, and the first and the second contacts being received in the through hole; and a second electrical connector comprising a third electrical contact and a fourth electrical contact encircling the third electrical contact, the third and the fourth contacts electrically engaging the first and second contacts respectively.

10. The electrical connector assembly as described in claim 9, wherein the third and the fourth contacts electrically engage the first and the second contacts within the through hole.

11. An RF connector assembly comprising:

a printed circuit board defining opposite upper and bottom faces thereon with a through hole extending therethrough;

a receptacle defining an insulative housing and coaxially extending outer and inner conductors attached thereto, both of said inner and outer conductors defining corresponding solder pads, respectively, which are located radially away from said center and define soldering faces located on a common plane, said receptacle upwardly inserted into said through hole with said soldering faces of said solder pads soldered on the bottom face of the printed circuit board, both said inner and outer conductors being received within the through hole; and a plug defining coaxial inner and outer terminals and downwardly inserted into and received within the through hole to mechanically and electrically engage the corresponding inner and outer conductors of the receptacle, respectively.

* * * * *